US009675134B2

(12) United States Patent
Kosui et al.

(10) Patent No.: US 9,675,134 B2
(45) Date of Patent: Jun. 13, 2017

(54) FOOTWEAR, AND KNITTING METHOD FOR KNIT FABRIC

(71) Applicant: SHIMA SEKI MFG., LTD., Wakayama-shi, Wakayama (JP)

(72) Inventors: Tatsuya Kosui, Wakayama (JP); Takashi Kino, Wakayama (JP); Yohji Hamada, Wakayama (JP)

(73) Assignee: SHIMA SEIKI MFG., LTD., Wakayama-Shi, Wakayama (JP)

( * ) Notice: Subject to any disclaimer, the term of this patent is extended or adjusted under 35 U.S.C. 154(b) by 0 days.

(21) Appl. No.: 14/371,487

(22) PCT Filed: Dec. 7, 2012

(86) PCT No.: PCT/JP2012/081747
§ 371 (c)(1),
(2) Date: Jul. 10, 2014

(87) PCT Pub. No.: WO2013/108506
PCT Pub. Date: Jul. 25, 2013

(65) Prior Publication Data

US 2015/0107307 A1 Apr. 23, 2015

(30) Foreign Application Priority Data

Jan. 20, 2012 (JP) ..... 2012-010202

(51) Int. Cl.
*A43B 17/00* (2006.01)
*A43B 1/04* (2006.01)
(Continued)

(52) U.S. Cl.
CPC ..... *A43B 17/003* (2013.01); *A43B 1/04* (2013.01); *A43B 23/0205* (2013.01);
(Continued)

(58) Field of Classification Search
CPC ... D04B 1/12; D04B 1/16; D04B 1/18; D04B 1/20; D04B 1/26; D04B 1/108;
(Continued)

(56) References Cited

U.S. PATENT DOCUMENTS 5,778,702 A * 7/1998 Wrightenberry ..... A41B 11/005 2/239
6,158,253 A * 12/2000 Svoboda ..... A41B 11/004 2/239
(Continued)

FOREIGN PATENT DOCUMENTS

EP 2 702 887 A1 3/2014
EP 2157221 B1 11/2015
(Continued)

OTHER PUBLICATIONS

Supplemental European Search Report cited in EP12865584.2 dated May 28, 2015, 7 pgs.
(Continued)

*Primary Examiner* — Danny Worrell
*Assistant Examiner* — Griffin Hall
(74) *Attorney, Agent, or Firm* — Rothwell, Figg, Ernst & Manbeck PC

(57) ABSTRACT

Provided is a footwear that excels in productivity and shape retaining property. Footwear is knitted seamlessly with a flat knitting machine having at least a pair of a front and a back needle bed and includes a base knit fabric portion having a mixed section knitted using a first knitting yarn and a second knitting yarn interwoven along the first knitting yarn. The first knitting yarn configuring the mixed section of the footwear is a knitting yarn that is not a heat-fusible yarn, and the second knitting yarn is a heat-fusible yarn having thermal adhesiveness and heat-shrinkable properties. The second knitting yarn preferably has a configuration includ-
(Continued)

ing a core made from a material that contracts by heat, and a sheath made from a material having a lower fusing point than the core.

3 Claims, 4 Drawing Sheets

(51) Int. Cl.

| | |
|---|---|
| ***A43B 23/02*** | (2006.01) |
| ***A43B 23/04*** | (2006.01) |
| ***A43B 13/04*** | (2006.01) |
| ***D04B 1/10*** | (2006.01) |
| ***D04B 1/22*** | (2006.01) |
| ***D04B 1/26*** | (2006.01) |
| ***A41B 11/00*** | (2006.01) |

(52) U.S. Cl.
CPC ..... *A43B 23/042* (2013.01); *D04B 1/108* (2013.01); *D04B 1/22* (2013.01); *D04B 1/26* (2013.01); *A41B 11/005* (2013.01); *A43B 13/04* (2013.01); *D10B 2501/043* (2013.01)

(58) Field of Classification Search
CPC ..... D04B 1/22; D10B 2501/043; A43B 1/04; A43B 23/0205; A43B 23/042; A43B 13/04; A41B 11/005
USPC ..... 66/177
See application file for complete search history.

(56) References Cited

U.S. PATENT DOCUMENTS

| | | | | |
|---|---|---|---|---|
| 6,588,237 | B2 * | 7/2003 | Cole | D04B 1/16 66/201 |
| 8,997,529 | B1 * | 4/2015 | Podhajny | D04B 1/16 36/47 |
| 8,997,530 | B1 * | 4/2015 | Podhajny | A43B 1/04 36/47 |
| 2004/0118018 | A1 * | 6/2004 | Dua | A43B 1/04 36/45 |
| 2008/0053157 | A1 * | 3/2008 | Golding | A41D 19/015 66/174 |
| 2008/0110048 | A1 * | 5/2008 | Dua | A43B 1/04 36/45 |
| 2010/0154256 | A1 * | 6/2010 | Dua | A43B 1/04 36/25 R |
| 2013/0145652 | A1 * | 6/2013 | Podhajny | A43B 23/0245 36/50.1 |
| 2014/0137433 | A1 * | 5/2014 | Craig | A43B 1/04 36/50.1 |
| 2015/0075031 | A1 * | 3/2015 | Podhajny | A43B 1/04 36/45 |

FOREIGN PATENT DOCUMENTS

| | | | | |
|---|---|---|---|---|
| JP | 56-160905 | U | | 11/1981 |
| JP | 5953701 | A | | 3/1984 |
| JP | 2004-105323 | B2 | | 4/2004 |
| JP | 2006-511306 | A | | 4/2006 |
| JP | 2008-303492 | A | | 12/2008 |
| JP | 2009179907 | A | * | 8/2009 |
| JP | 2011-226019 | A | | 11/2011 |
| WO | 2004/060093 | A1 | | 7/2004 |
| WO | WO 2008139710 | A1 | | 11/2008 |

OTHER PUBLICATIONS

International Search Report cited in PCT/JP2012/081747 dated Feb. 19, 2013, 2 pgs.

Notification of Reasons for Refusal (and machine translation) issued in Japanese Patent Application No. 2013-554201, 6 pages (Oct. 5, 2016).

* cited by examiner

FOOTWEAR, AND KNITTING METHOD FOR KNIT FABRIC

CROSS REFERENCE TO RELATED APPLICATION

This application is a 35 U.S.C. 371 National Phase Entry Application from PCT/JP2012/081747, filed Dec. 7, 2012, which claims the benefit of Japanese Patent Application No. 2012-010202 filed on Jan. 20, 2012, the disclosure of which is incorporated herein in its entirety by reference.

TECHNICAL FIELD

The present invention relates to a footwear such as socks, shoes, and the like knitted seamlessly with a flat knitting machine, and a knitting method for a knit fabric of producing the footwear.

BACKGROUND ART

For example, patent document 1 discloses a pair of shoes, which is one type of footwear. The shoe includes an upper (denoted as an instep covering portion in patent document 1), and a sole attached to the upper, and a part of the upper includes an "interwoven portion" in which the fiber of synthetic resin is interwoven. Because of such "interwoven portion" formed at the upper, when the upper is subjected to thermal processing while being placed over a last (denoted as shoe form in patent document 1), the upper can be formed to a shape that lies along the shape of the last.

PRIOR ART DOCUMENT

Patent Document

[Patent Document 1] Japanese Patent Publication No. 3865307

SUMMARY OF THE INVENTION

Problems to Be Solved By the Invention

The conventional shoes have a problem in that the productivity is poor. Since the shoes are formed by three-dimensionally sewing a plurality of parts, it is troublesome to prepare each part and the task of sewing each part is also complicated. Furthermore, the shoes of patent document 1 also have a problem that the shape retaining property is poor since the "interwoven portion" of the shoes is made only from the fiber of the synthetic resin.

The present invention has been made in view of the above situation, and an object of the present invention is to provide a footwear that excels in productivity and shape retaining property. Another object of the present invention is to provide a knitting method for a knit fabric of producing the footwear of the present invention.

Means for Solving the Problems

A footwear according to the present invention is a footwear knitted seamlessly with a flat knitting machine having at least a pair of a front and a back needle bed, and includes a base knit fabric portion including a mixed section knitted using a first knitting yarn and a second knitting yarn interwoven along the first knitting yarn. The first knitting yarn used in the mixed section of the footwear of the present invention is a knitting yarn that is not a heat-fusible yarn, and the second knitting yarn is a heat-fusible yarn having thermal adhesiveness and heat-shrinkable properties.

The footwear of the present invention includes socks, tabi (mitten socks), shoes or the upper of the shoes, and the like. The mixed section in the footwear of the present invention may be arranged over the entire footwear or may be arranged at a part of the footwear. Further, the mixed section in the footwear of the present invention does not need to be uniformly formed. For example, the knitting structure, the type of knitting yarn to use, the count of the knitting yarn, and the like may differ between the mixed section at a certain part of the footwear and the mixed section at another part of the footwear (the type, count, and the like may, of course, be the same).

According to one aspect of the footwear of the present invention, the heat-fusible yarn configuring the second knitting yarn is a heat-fusible yarn having a core-sheath structure including a core that contracts by heat and a sheath having a lower fusing point than the core.

The fusing point of the core and the sheath of the heat-fusible yarn having the core-sheath structure is a temperature higher than the temperature of the general usage environment of the footwear. For example, the fusing point of the core and the sheath is preferably higher than or equal to 120° C.

According to another aspect of the footwear of the present invention, the mixed section arranged in the footwear is knitted by plating knitting using the first knitting yarn and the second knitting yarn.

If the plating knitting (see e.g., International Laid-Open Publication No. 2008/139710, Japanese Patent Publication No. 3899269) of feeding the first knitting yarn and the second knitting yarn from different yarn feeders is carried out, a main yarn fed from the preceding yarn feeder is arranged on the front surface side of the mixed section, and a plating yarn fed from the following yarn feeder is arranged on the back surface side of the mixed section. Thus, it is apparent that the mixed section is formed by plating knitting by looking at the mixed section. The mixed section may be knitted by feeding the first knitting yarn and the second knitting from one yarn feeder. In this case, the first knitting yarn and the second knitting yarn supplied from different knitting yarn cones may be put together in one yarn feeder, or the first knitting yarn and the second knitting yarn may be put together in advance by twisting and the like and then fed from one yarn feeder. In addition, the second kitting yarn may be interwoven along the first knitting yarn by tucking the second knitting yarn to the stitches knitted with the first knitting yarn.

According to another aspect of the present invention, the footwear further includes an additional knit fabric portion arranged on an inner side or an outer side of the base knit fabric portion when wearing the footwear; wherein the base knit fabric portion and the additional knit fabric portion are connected seamlessly at a position of a foot-inserting part of the footwear. The additional knit fabric portion may also include the mixed section knitted using the first knitting yarn and the second knitting yarn.

According to another aspect of the footwear of the present invention in which the mixed section of the base knit fabric portion is knitted by plating knitting and an additional knit fabric portion is arranged, a surface on which the second knitting yarn is arranged in the mixed section is arranged to face the additional knit fabric portion.

In the mixed section performed with the plating knitting as described above, the second knitting yarn, which is the heat-fusible yarn, is arranged on either the front surface side or the back surface side of the mixed section. The second knitting yarn, which is the heat-fusible yarn, is arranged between the base knit fabric portion and the additional knit fabric portion by arranging the surface, on which the second knitting yarn is arranged in the mixed section, to face the additional knit fabric portion when the additional knit fabric portion is arranged on the inner side or the outer side of the base knit fabric portion. If the additional knit fabric portion also includes the mixed section, the surface on which the second knitting yarn is arranged in the base knit fabric portion and the surface on which the second knitting yarn is arranged in the additional knit fabric portion preferably face each other.

According to another aspect of the footwear of the present invention, the footwear is retained in a shape corresponding to a last by being thermally processed while being placed over the last. In this case, the second knitting yarn fused by being thermally processed and the first knitting yarn are integrated in the mixed section of an outer side knit fabric portion of the footwear. In particular, if the second knitting yarn is the heat-fusible yarn having the core-sheath structure, the core of the second knitting yarn and the first knitting yarn are integrated in a paralleled state by the sheath of the second knitting yarn fused by the thermal processing.

The footwear described above is produced by a knitting method for a knit fabric of the present invention of seamlessly knitting a knit fabric using a flat knitting machine having at least a pair of a front and a back needle bed facing each other. In other words, in the knitting method for the knit fabric of the present invention, a first knitting yarn, which is not a heat-fusible yarn, and a second knitting yarn, which is a heat-fusible yarn having thermal adhesiveness and heat-shrinkable properties, are prepared; and at least a part of the footwear is knitted with the first knitting yarn and the second knitting yarn interwoven along the first knitting yarn.

Effects of the Invention

The footwear of the present invention excels in productivity as it is knitted seamlessly. The footwear of the present invention is a footwear that excels in shape retaining property by being thermally processed while being attached to the last. This is because the second knitting yarn fused by the thermal processing is integrated with the first knitting yarn, so that the first knitting yarn becomes the skeleton in the mixed section and the fused second knitting yarn reinforces such skeleton. The footwear of the present invention also has excellent appearance. This is because the first knitting yarn is not a heat-fusible yarn and thus the first knitting yarn in the mixed section of the footwear is not fused even if the footwear of the present invention is thermally processed, and the knitting structure of the mixed section is retained in a state at the time of knitting.

The footwear of the present invention knitted using the second knitting yarn having the core-sheath structure exhibits superior shape retaining property. When the footwear is attached to the last and thermally processed, the core of the second knitting yarn contracts and the shape of the footwear lies along the last, and furthermore, the core and the first knitting yarn are integrated by the sheath of the second knitting yarn.

The footwear of the present invention in which the mixed section is formed by the plating knitting has excellent appearance. According to the plating knitting, the main yarn (one of the first knitting yarn and the second knitting yarn) is arranged on the front side of the mixed section, and the plating yarn (the other one of the first knitting yarn and the second knitting yarn) is hidden on the back side of the mixed section and is difficult to be seen from the front side of the mixed section, that is, the first knitting yarn and the second knitting yarn are not seen as mottles. Which one of the first knitting yarn or the second knitting yarn to be assumed as the knitting yarn fed from the preceding yarn feeder is not particularly limited, but the first knitting yarn is preferably the knitting yarn fed from the preceding yarn feeder. This is because the first knitting yarn is the knitting yarn that determines the outer appearance of the mixed section.

The footwear of the present invention including the additional knit fabric portion in addition to the base knit fabric portion has excellent comfortableness. This is because the additional knit fabric portion facing the foot of the wearer may be formed to have a texture different from the base knit fabric portion.

The adherence property of the base knit fabric portion and the additional knit fabric portion can be enhanced by arranging, on the side of the additional knit fabric portion, the surface on which the second knitting yarn is arranged in the mixed section formed by plating knitting.

MODE FOR CARRYING OUT THE INVENTION

An example of knitting a shoe 1 as a footwear of the present invention will now be described with reference to FIGS. 1 to 3.

Figure 1:
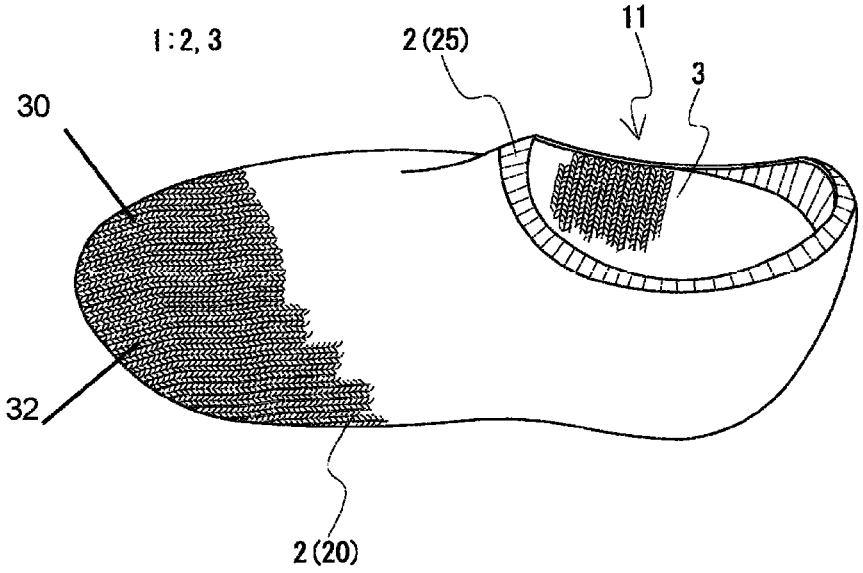
FIG. 1 is a schematic perspective diagram of a shoe shown in an embodiment.

The shoe 1 shown in FIG. 1 is a shoe in which an upper that covers an instep side of a foot, and a sole that covers a sole side are integrated. A reinforcement sole material (not shown) such as resin, rubber, and the like, for example, may be attached to the outer side of the sole of the shoe 1. The reinforcement sole material is preferably attached to the sole with an adhesive. Of course, the reinforcement sole material may be formed by impregnating the sole with the resin, rubber, and the like.

The shoe 1 of the present embodiment includes an outer side knit fabric portion (base knit fabric portion) 2 arranged on the outer side of the shoe 1, and an inner side knit fabric portion (additional knit fabric portion) 3 arranged on the inner side of the shoe 1. The outer side knit fabric portion 2 and the inner side knit fabric portion 3 are connected at a position of a foot-inserting part 11 of the shoe 1. A distinctive feature of the shoe 1 is that (1) the entire shoe 1 is a knit fabric seamlessly knitted using a flat knitting machine, and (2) at least a part (mixed section 20) of the outer side knit fabric portion 2 configuring the shoe 1 is knitted with a first knitting yarn 30, which is not a heat-fusible yarn, and a second knitting yarn 32, which is a heat-fusible yarn interwoven along the first knitting yarn.

Figure 2:
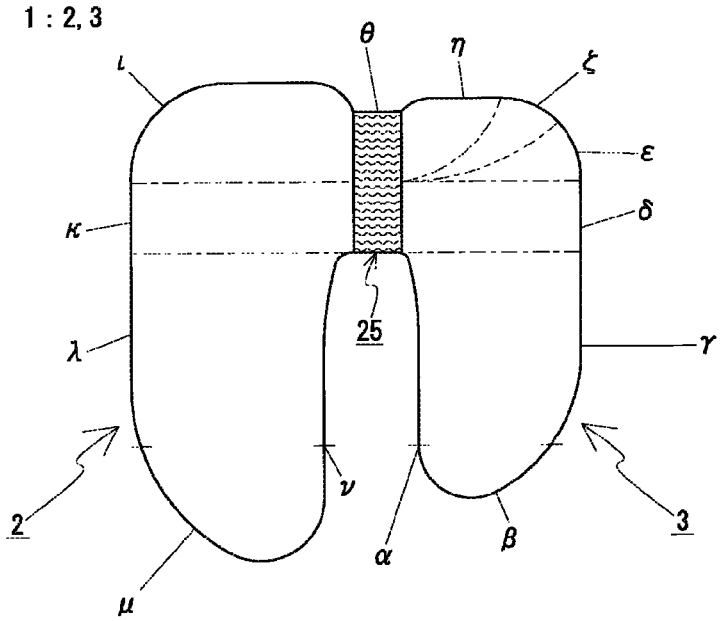
FIG. 2 is a schematic diagram showing a state before thermal processing of the shoe shown in FIG. 1.

To produce the shoe 1 shown in FIG. 1, the knit fabric (shoe 1) in which the outer side knit fabric portion 2 and the inner side knit fabric portion 3 are seamlessly connected is first knitted as shown in FIG. 2 using a flat knitting machine. In this case, the inner side knit fabric portion 3 is preferably formed to a shape substantially lying along the shape of the last, to be described later and slightly larger than the size of the last, and the outer side knit fabric portion 2 is preferably formed slightly larger than the inner side knit fabric portion 3. The flat knitting machine to be used for the knitting is not particularly limited, and may be, for example, a two-bed flat knitting machine or a four-bed flat knitting machine.

Figure 3:
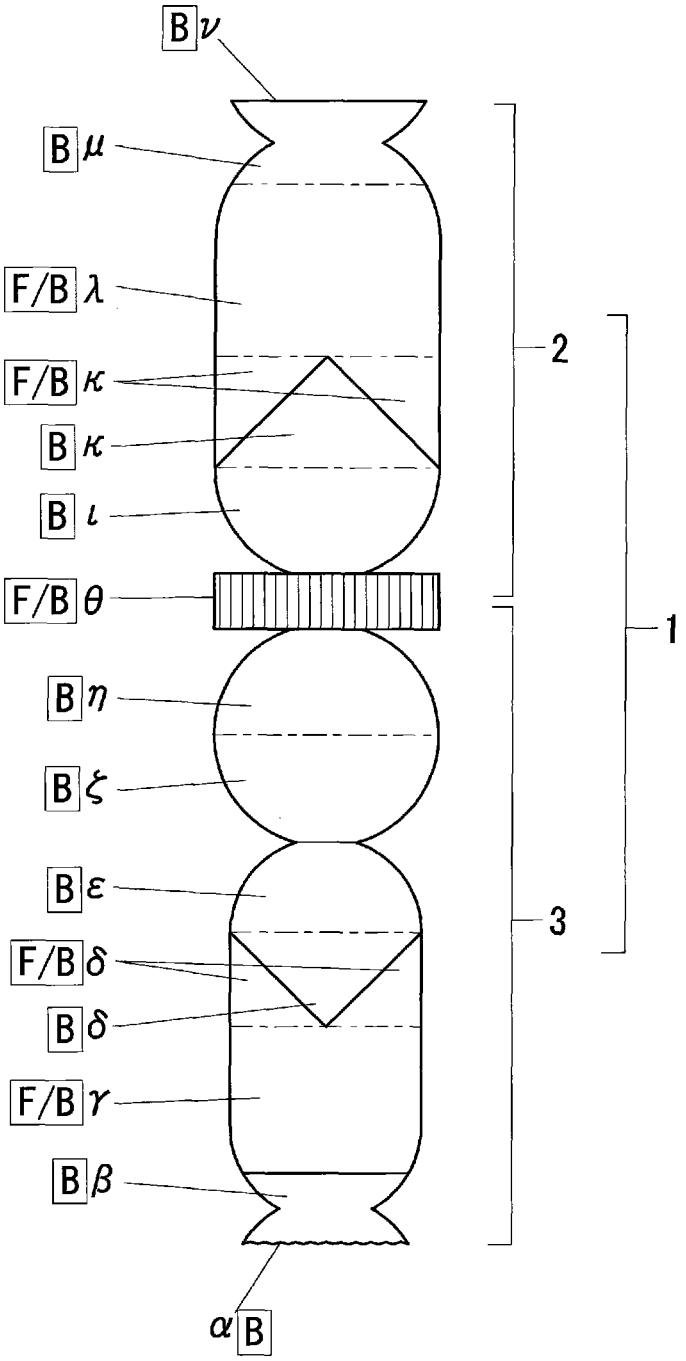
FIG. 3 is a knitting image diagram of the shoe shown in FIG. 2.

FIG. 3 shows the knitting image diagram schematically showing the knitting steps of the shoe 1 shown in FIG. 2. Portions α to ν shown in FIG. 3 correspond to portions α to ν of FIG. 2. The squared letters next to the portions α to ν of FIG. 3 indicate the needle beds (F=front needle bed, B=back needle bed) for knitting the relevant portion.

As shown in FIG. 3, the knitting is first started from the portion α corresponding to the roots of the toes on the instep side of the inner side knit fabric portion 3, and the portion β of the inner side knit fabric portion 3 surrounding the toes is knitted. Next, the portions γ, δ, ϵ, ζ, η of the inner side knit fabric portion 3 are formed so as to correspond to the irregularities of the foot while using narrowing and widening (portion γ is knitted with tubular kitting using F, B, and portion δ is knitted with C-shaped knitting using F, B). The portion θ is knitted with a rib structure, the portions ι, κ, λ, μ of the outer side knit fabric portion 2 are knitted so as to correspond to the irregularities of the foot while again using widening and narrowing (portion κ is knitted with C-shaped knitting using F, B and portion λ is knitted with tubular knitting using F, B) and knitting is finished at the portion ν corresponding to the roots of the toes.

In the present embodiment, the knitting yarn for knitting the inner side knit fabric portion 3 and the knitting yarn for knitting the outer side knit fabric portion 2 are different. The inner side knit fabric portion 3 is arranged to face the foot of the wearer, and hence is knitted using a knitting yarn that enhances the comfortableness of the wearer. For such knitting yarn, a knitting yarn having at least one of the properties of hygroscopic property, anti-bromic property, and antibacterial property, for example, can be used. The heat-fusible yarn is preferably not adopted for the knitting yarn of the inner knit fabric portion 3 since the feeling degrades once the heat-fusible yarn is fused by thermal processing.

In the outer side knit fabric portion 2, a section other than a rib structure section 25 is a mixed section 20 knitted with the first knitting yarn (knitting yarn of a different type from the knitting yarn of the inner side knit fabric portion 3), which is not the heat-fusible yarn, and the second knitting yarn, which is the heat-fusible yarn, in a paralleled state. In the present embodiment, plating knitting of feeding the first knitting yarn from a preceding yarn feeder, and feeding the second knitting yarn from a following yarn feeder is carried out, so that the first knitting yarn, which is not the heat-fusible yarn, appears on the outer surface of the shoe 1. Only the first knitting yarn is used for the knitting of the rib structure section 25 so that the foot can be easily inserted from the foot-inserting part 11 of the shoe 1.

The knitting yarn, which is not the heat-fusible yarn, is used for the first knitting yarn. The material of the knitting yarn is preferably polyester, nylon, and the like, but is not limited thereto. The knitting yarn may be a monofilament yarn, or may be a multi-filament yarn. In particular, the multi-filament yarn is preferable, and the multi-filament yarn is adopted for the first knitting yarn in the present embodiment.

Figure 4:
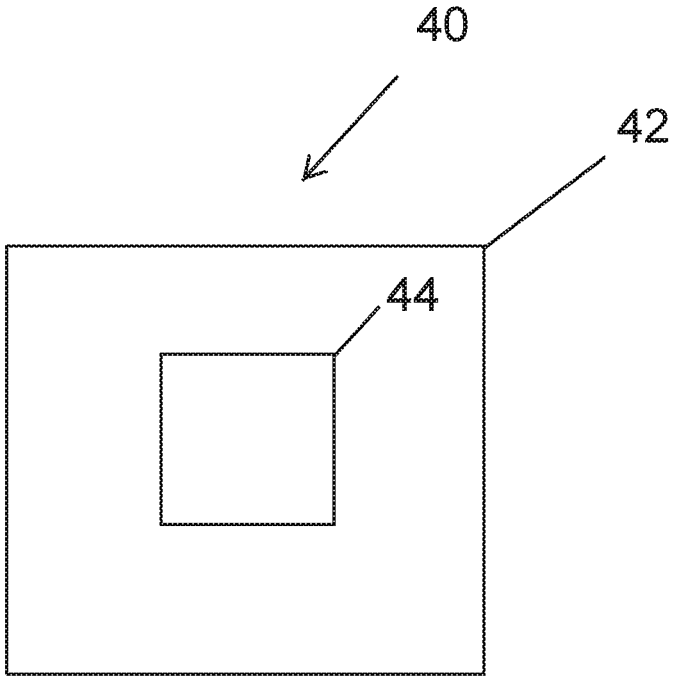
FIG. 4 is a schematic illustration of heat-fusible yarn having a core-sheath structure according to exemplary embodiments.
Figure 5:
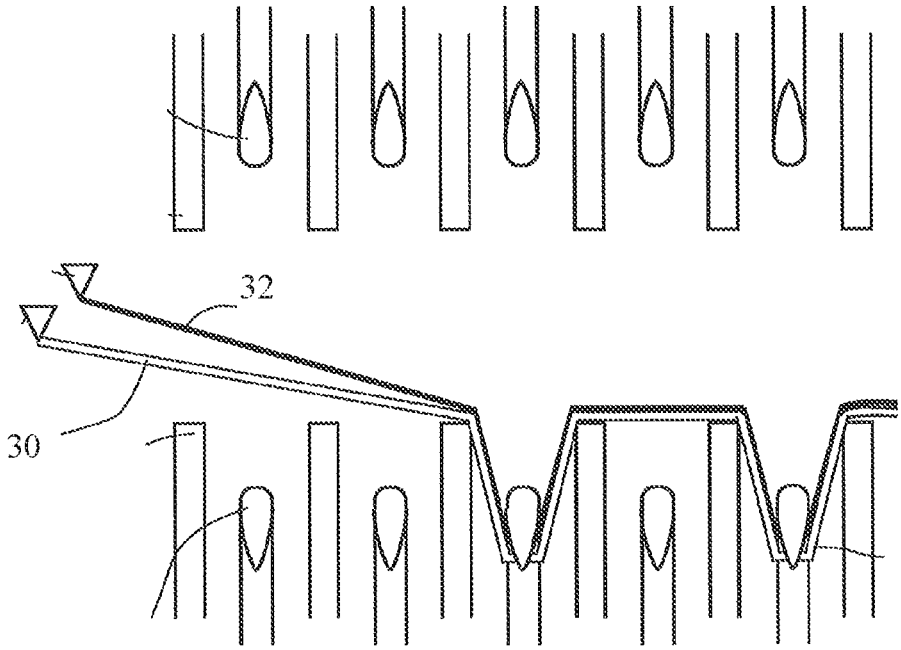
FIG. 5 PRIOR ART
FIG. 5 is a schematic illustration of a process of knitting a stitch by plating knitting.

The heat-fusible yarn having a core-sheath structure 40 (shown in FIG. 4) including a core 44 made from a material that contracts by heat, and a sheath 42 made from a material having a lower fusing point than the core is used for the second knitting yarn, which is the heat-fusible yarn. A contraction starting temperature (lower than the fusing point) of the core of the heat-fusible yarn and the fusing point of the sheath are preferably higher than or equal to 120° C., for example. Such heat-fusible yarn includes, for example, DIAFLORA (registered trademark of Toyobo Co. Ltd.).

The second knitting yarn is not limited to the core-sheath structure. For example, the knitting yarn having thermal adhesiveness and the knitting yarn having heat-shrinkable properties may be respectively prepared, and such knitting yarns may be paralleled at the time of knitting to obtain the second knitting yarn, or such knitting yarns may be twisted before the knitting to obtain the second knitting yarn.

After the knit fabric (shoe 1) of FIG. 2 having the configuration described above is knitted, the inner side knit fabric portion 3 of the knit fabric is folded into the interior of the outer side knitted fabric portion 2 through the rib structure section 25, and such knit fabric is placed over the last and thermally processed at a temperature of higher than or equal to the fusing point of the sheath of the second knitting yarn, the temperature being higher than or equal to the contraction starting temperature of the core and lower than the fusing point of the core. Thus, the outer side knit fabric portion 2 and the inner side knit fabric portion 3 are formed into a shape that exactly lies along the last with the contraction of the core of the second knitting yarn. In this case, the sheath of the fused second knitting yarn surrounds the outer circumference of the first knitting yarn and enters the gap of each filament of the first knitting yarn thus strongly integrating the core of the second knitting yarn and the first knitting yarn. The fused sheath also has a role of bonding the outer side knit fabric portion 2 and the inner side knit fabric portion 3 together.

Finally, the shoe 1 shown in FIG. 1 is obtained by detaching, from the last, the knit fabric that has subjected to the thermal processing. The obtained shoe 1 has a shape that lies along the last, and excels in shape retaining property. The shoe 1 excels in the shape retaining property because the first knitting yarn and the core of the second knitting yarn configure the skeleton in the outer side knit fabric portion 2, and the shape of the skeleton is retained by the sheath of the fused second knitting yarn. Further, in the shoe 1, the foot-inserting part 11 can be easily stretched since the foot-inserting part 11 is the rib structure section 25 made of a knitting yarn which is not the heat-fusible yarn, and hence the shoe 1 is easy to wear.

The present invention is not limited to the embodiment described above, and can be appropriately modified and implemented within a scope not deviating from the gist of the present invention. For example, unlike the first embodiment, the shoe 1 without the inner side knit fabric portion 3 may be realized. Moreover, in the mixed section 20 of the outer side knit fabric portion 2, the type and count of the first knitting yarn and second knitting yarn may be partially changed. For example, the first knitting yarn may be thickened at the portion corresponding to the heel to enhance the strength of the relevant portion, and the contractility of the second knitting yarn may be increased at the portion corresponding to the arch to strengthen the tightening of the foot by the relevant portion. Of course, in the shoe 1, the mixed section 20 may be arranged only at a specific portion such as the portion corresponding to the heel, the portion corresponding to the arch, and the like.

DESCRIPTION OF REFERENCE NUMERALS

1 shoe (footwear)
11 foot-inserting part
α to ν portion
2 outer side knit fabric portion (base knit fabric portion)
20 mixed section
25 rib structure section
3 inner side knit fabric portion (additional knit fabric portion)

The invention claimed is:

1. A footwear knitted seamlessly with a flat knitting machine having at least a pair of a front and a back needle bed, comprising:

a base knit fabric portion including a mixed section and knitted using a first knitting yarn and a second knitting yarn interwoven along the first knitting yarn; wherein the first knitting yarn is a knitting yarn that is not a heat-fusible yarn;

the second knitting yarn is a heat-fusible yarn having thermal adhesiveness and heat-shrinkable properties; and an additional knit fabric portion is arranged on an inner side or an outer side of the base knit fabric portion when wearing the footwear; wherein the base knit fabric portion and the additional knit fabric portion are connected seamlessly at a position of a foot-inserting part of the footwear, and wherein the mixed section of the base knit fabric portion is knitted by plating knitting using the first knitting yarn and the second knitting yarn; and a surface on which the second knitting yarn is arranged in the mixed section is arranged to face the additional knit fabric portion, wherein the footwear is retained in a shape corresponding to a last by being thermally processed while being placed over the last;

wherein in the mixed section, the second knitting yarn fused by the thermal processing is integrated with the first knitting yarn; and wherein the base knit fabric portion and the additional knit fabric portion are also integrated by the fused second knitting yarn.

2. The footwear according to claim 1, wherein the heat-fusible yarn includes a core that contracts by heat and a sheath having a lower fusing point than the core.

3. A knitting method for knitting a footwear seamlessly using a flat knitting machine having at least a pair of a front and a back needle bed facing each other; wherein the footwear includes a footwear-shaped base knit fabric portion and a footwear-shaped additional knit fabric portion arranged on an inner side or an outer side of the base knit fabric portion;

the base knit fabric portion and the additional knit fabric portion are integrally knitted so as to be connected seamlessly at a position of a foot-inserting part of the footwear;

when the base knit fabric portion is knitted, a mixed section is knitted in at least a part of the base knit fabric portion by plating knitting using a first knitting yarn, which is not a heat-fusible yarn, and a second knitting yarn, which is a heat-fusible yarn having thermal adhesiveness and heat-shrinkable properties; and the plating knitting is carried out with a surface on which the second knitting yarn is arranged in the mixed section being arranged to face the additional knit fabric portion, the footwear is retained in a shape corresponding to a last by being thermally processed while being placed over the last;

in the mixed section, the second knitting yarn fused by the thermal processing is integrated with the first knitting yarn; and the base knit fabric portion and the additional knit fabric portion are also integrated by the fused second knitting yarn.

* * * * *